US005505594A

United States Patent [19]

Sheehan

[11] Patent Number: 5,505,594

[45] Date of Patent: Apr. 9, 1996

[54] PUMP WITH CO-AXIAL MAGNETIC COUPLING

[76] Inventor: Kevin Sheehan, 505 Reita St., Ballston Spa, N.Y. 12020

[21] Appl. No.: 420,869

[22] Filed: Apr. 12, 1995

[51] Int. Cl.[6] ..... F04B 17/00

[52] U.S. Cl. ..... 417/420; 417/362; 415/72

[58] Field of Search ..... 417/420, 362, 417/356; 415/72, 124.1

[56] References Cited

U.S. PATENT DOCUMENTS

| | | | |
|---|---|---|---|
| 242,400 | 5/1881 | Voelker | 415/72 |
| 928,782 | 7/1909 | Morrison | 415/124.1 |
| 1,534,451 | 4/1925 | Kauter | 717/356 |
| 2,425,423 | 8/1947 | Donaldson | 415/124.1 |
| 2,500,400 | 3/1950 | Cogswell | 415/124.1 |
| 2,736,264 | 2/1956 | Emlers | 415/72 |
| 2,827,856 | 3/1958 | Zozulin | 417/420 |
| 3,064,879 | 11/1962 | Carlson | 415/72 |
| 3,249,777 | 5/1966 | Congdon et al. | 417/420 |
| 3,723,029 | 3/1973 | Laing | 417/420 |
| 3,972,653 | 8/1976 | Travis et al. | 415/72 |
| 3,977,816 | 8/1976 | Laing | 417/420 |
| 4,123,666 | 10/1978 | Miller | 415/124.1 |
| 4,838,763 | 6/1989 | Kramer | 417/420 |
| 4,890,988 | 1/1990 | Kramer et al. | 417/420 |
| 5,017,087 | 5/1991 | Sneddon | 415/72 |
| 5,084,189 | 1/1992 | Richter | 415/124.1 |
| 5,209,650 | 5/1993 | LeMieux | 417/356 |

*Primary Examiner*—Peter Korytnyk
*Assistant Examiner*—Peter G. Korytwyk
*Attorney, Agent, or Firm*—Schmeiser, Olsen & Watts

[57] ABSTRACT

Disclosed is a pump that employs a magnetic coupling to connect the motor to the impeller. A simplified structure within the pump casing is employed to enable the easy removal of the pump's impeller and bushings and/or bearings. In one embodiment of the invention, the exterior surface of the impeller, including its attached magnets, is encased in a plastic bushing material. Surrounding the impeller is a tubular bushing that may at times come into contact with the bushing material of the impeller.

14 Claims, 5 Drawing Sheets

PUMP WITH CO-AXIAL MAGNETIC COUPLING

FIELD OF THE INVENTION

The invention is in the field of apparatus designed to pump a fluid material. More particularly, the invention is a sealless pump that employs a magnetic coupling to drive the impeller. The pump includes a simplified structure for supporting the impeller and facilitating the pump's maintenance.

BACKGROUND OF THE INVENTION

In an effort to prevent leakage of hazardous fluids from piping systems, the use of sealless pumps has become more common. While pumps of this type may employ seals at non-critical locations, the pump's primary characteristic is that a shaft seal is not required. The pump's impeller is caused to rotate by an apparatus that does not penetrate the piping system. In this manner, a primary site for leakage is avoided.

A typical sealless pump makes use of a magnetic coupling to drive the impeller. An example of this type of pump is provided by Zozulin in U.S. Pat. No. 2,827,856. Disclosed in the patent is an axial flow pump in which a cylindrical impeller has exterior magnets that are magnetically coupled to complementary magnets located outside of the pump casing. The exterior magnets are secured to a housing that rotates about the pump casing through the use of a pulley and belt system coupled to a motor. It should be noted that in the Zozulin reference, bushings having end-located seals are positioned at each end of the impeller to support the impeller and to seal its outer surface from the fluid being pumped.

Prior art sealless pumps, while avoiding the shaft seal problems experienced by more conventional pumps, still suffer a number of problems. The pumps typically employ a complicated structure of bearings and/or bushings and/or seals to support the impeller. In addition, various seals are employed to either seal the impeller's outer surface from the fluid being pumped or to route the pumped fluid about the impeller for cooling purposes. This makes the units expensive to manufacture and difficult to maintain. The complexity of the prior art units also adversely affects their durability and expected life-span.

SUMMARY OF THE INVENTION

The invention is a sealless pump that employs a magnetic coupling between the impeller and a rotatable housing located exterior to the pump casing. The invention makes use of a simplified impeller support structure within the casing.

The motor portion of the pump may be mounted to the pump casing, is preferably of the conventional type, and is connected by a belt and pulley system or, alternatively, a gear drive to the rotatable housing. A plurality of axially-aligned magnets are spaced about the interior face of the housing. These magnets rotate with the housing and are magnetically coupled to a complementary set of magnets located within the casing of the pump.

The magnets located within the pump casing are secured to an outer portion of the pump's impeller. As the magnets rotate within the casing, an auger-shaped inner surface of the impeller acts on the fluid within the casing to thereby achieve the pumping function of the pump.

The invention includes three different embodiments of support structure for the impeller. In the first embodiment, a simple sealed bearing is employed at each end of the impeller. Removable rings or 'C'-clips are preferably used to maintain the position of the bearings within the body of the pump. The bearings include internal seals that prevent the pumped fluid from entering the area around the magnets.

In the second embodiment of the invention, threaded bushings are employed in conjunction with sealed bearings to support the impeller. Complementary threads in the interior surface of the pump casing maintain the position of the bushings.

In the third embodiment, the impeller is supported using matched sets of self-lubricating bushings. In this embodiment, the driven magnets are encased in a plastic bushing material that is coupled with both a cylindrical outer bushing and a pair of end-located bushings.

In all three embodiments of the invention, the pump casing is basically a straight tube that has a large opening at each end. The openings are sized to enable easy removal of the impeller and its support structure.

DETAILED DESCRIPTION OF THE DRAWINGS

Figure 1:
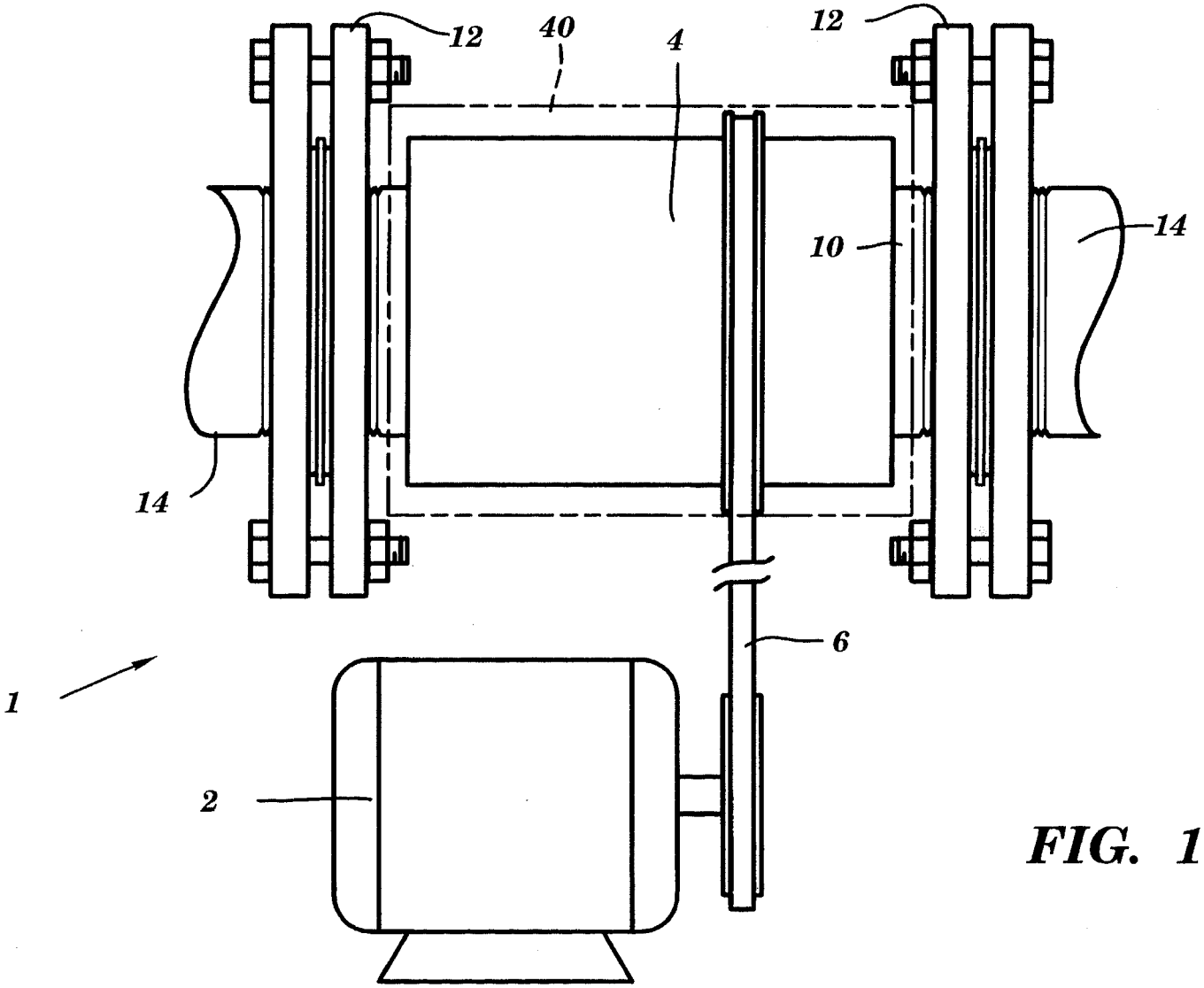
FIG. 1 is a generalized exterior view of a sealless pump in accordance with the invention.

Referring now to the drawings in greater detail, wherein like reference characters refer to like parts throughout the several figures, there is shown by the numeral 1 a sealless pump in accordance with the invention.

In FIG. 1, a generalized view of the pump structure is provided. The pump is composed of an electric motor 2 that is connected to a rotatable housing 4 using a belt drive 6. The housing surrounds a portion of a pump casing 10. The casing is connected by flanges 12 to a piping system 14 that contains a fluid. The pump acts to increase the head of the fluid being pumped.

Figure 2:
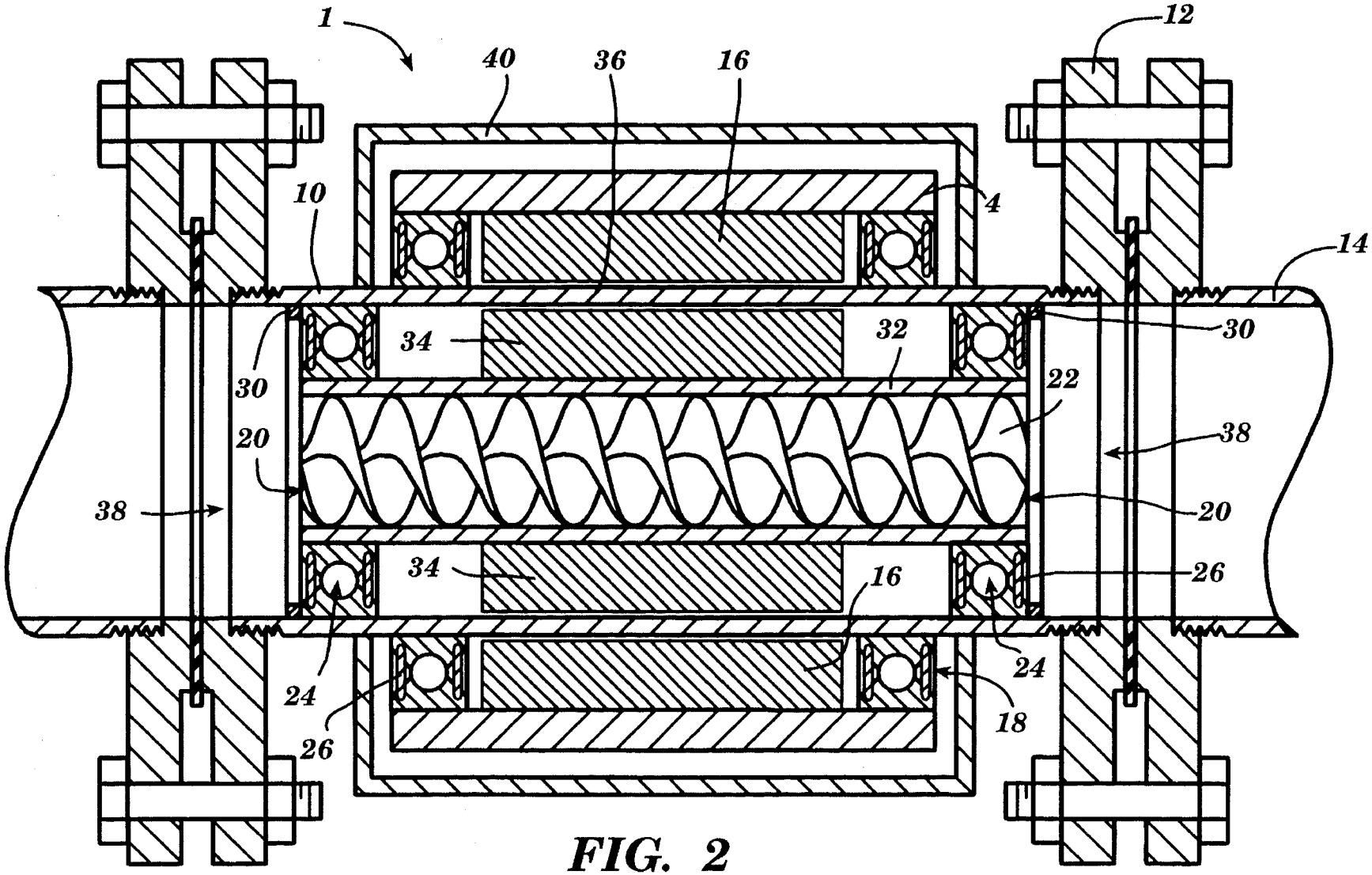
FIG. 2 is a cross-sectional view in the area of the pump casing of the pump shown in FIG. 1.

FIG. 2 shows a detailed, cross-sectional view in the area of the pump casing of a first embodiment of the invention. In this view, it can be seen that the interior surface of housing 4 includes a plurality of inwardly extending and axially-aligned magnets 16. As the housing rotates about the pump casing, the magnets similarly rotate about the casing. End-located bearings 18 support the housing on the exterior surface of the pump casing.

Located within the pump casing is a rotatable impeller 20 that has an auger-shaped internal surface 22. The impeller is rotatably supported at each end by bearings 24. The bearings include internal seals 26 that prevent fluid flow past the bearings.

The bearings 24 are maintained in the position shown by removable rings 30. The rings are preferably held in place using a conventional threaded engagement (not detailed)

between threads located on the exterior surface of the rings and complementary threads located on the inside surface of the casing. It should be noted that other conventional methods may be employed to secure the bearings. One alternative is to use removable 'C'-clips that fit within a groove in the casing in place of the threaded rings 30. Another alternative is to use a press-fit engagement between the exterior of the bearings 24 and the interior surface of the pump casing.

Each bearing 24 is preferably sealed and is either self-lubricating or contains a quantity of lubricant. Alternatively, each bearing may include a grease fitting (not shown) that extends through the pump casing 10. It should be noted that when a grease fitting is employed, the shaft of the fitting would be non-movable and therefore a complicated seal structure would not be required.

The impeller 20 has a cylindrical outer surface 32 upon which a plurality of axially-aligned and spaced-apart magnets 34 are permanently secured. The magnets are located on surface 32 at positions whereby they are aligned with the magnets 16 located on the rotatable outer housing 4. In this manner, the magnets 16 become magnetically coupled to magnets 34. It should be noted that the outer wall 36 of the pump casing that is located between the inner and outer sets of magnets is extremely thin. This allows the separation distance between the magnets to be relatively small and thereby enables a strong magnetic coupling between the magnets. Wall 36 may be made from a metal material or a plastic material. The use of a plastic material for the wall is advantageous since it avoids the heat build-up caused by the sweeping magnetic field produced by the rotating magnets.

It should be noted that each end of the tubular pump casing includes a large opening 38. The opening has a diameter greater than that of the bearings and impeller. In this manner, the opening allows easy and complete removal of the impeller and its entire support structure from either end of the casing when either of the flanges 12 have been disconnected from the piping system 14.

As shown in FIG. 2, the pump may also include a safety cover 40. The cover is preferably made of a rigid material and is used to isolate the housing 4 and its associated bearings from inadvertent external contact.

Figure 3:
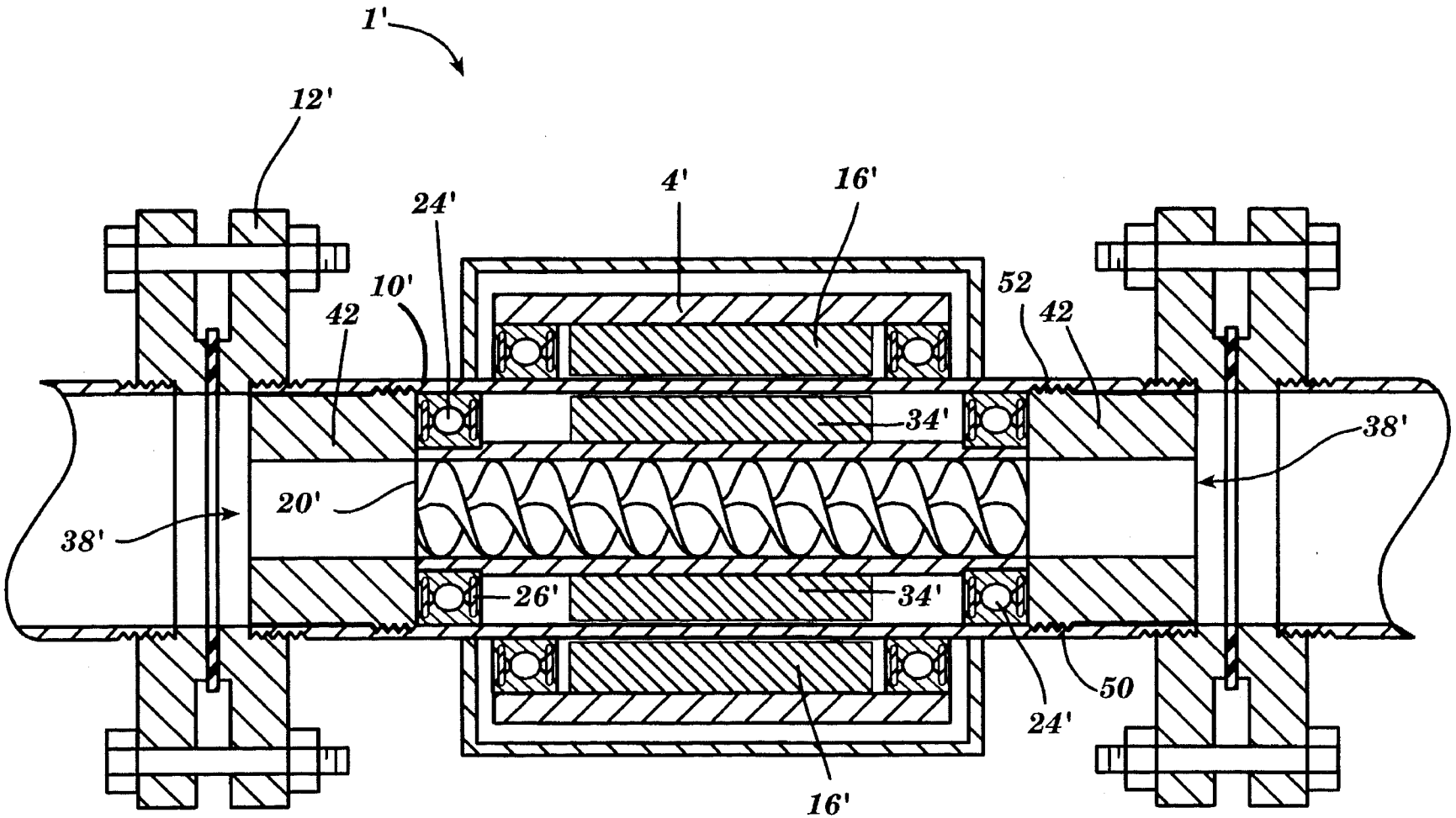
FIG. 3 is a cross-sectional view in the area of the pump casing of a second embodiment of a sealless pump in accordance with the invention.

FIG. 3 provides a detailed view in the area of the pump casing of a second embodiment 1' of the invention. This embodiment is basically identical to that of the first embodiment except that threaded bushings 42 are used to maintain the position of self-lubricating bearings 24' within the pump casing 10'. It should be noted that bearings 24' include fluid-tight seals 26' that function to prevent fluid from getting past the bearings and into the area about magnets 34'.

Opposite end portions of the casing include threads 50 that are complementary to threads 52 located on the exterior surface of the bushings 42. In this manner, the impeller 20' and its bearings 24' may be maintained in the proper position by appropriate adjustment of the location of the bushings 42 using the threads 50, 52.

Either of the bushings 42 may be easily removed from the pump casing due to the threaded engagement. Once one or both of the flanges 12 have been separated from the piping system, the adjacent bushing(s) 42 may be removed through the opening 38' located at the respective end of the casing. Then, the impeller and its associated bearings may be removed through the same opening. It should be noted that the end- located openings 38' in the pump casing are slightly greater in diameter than the bushings 42 and impeller 20'.

Figure 4:
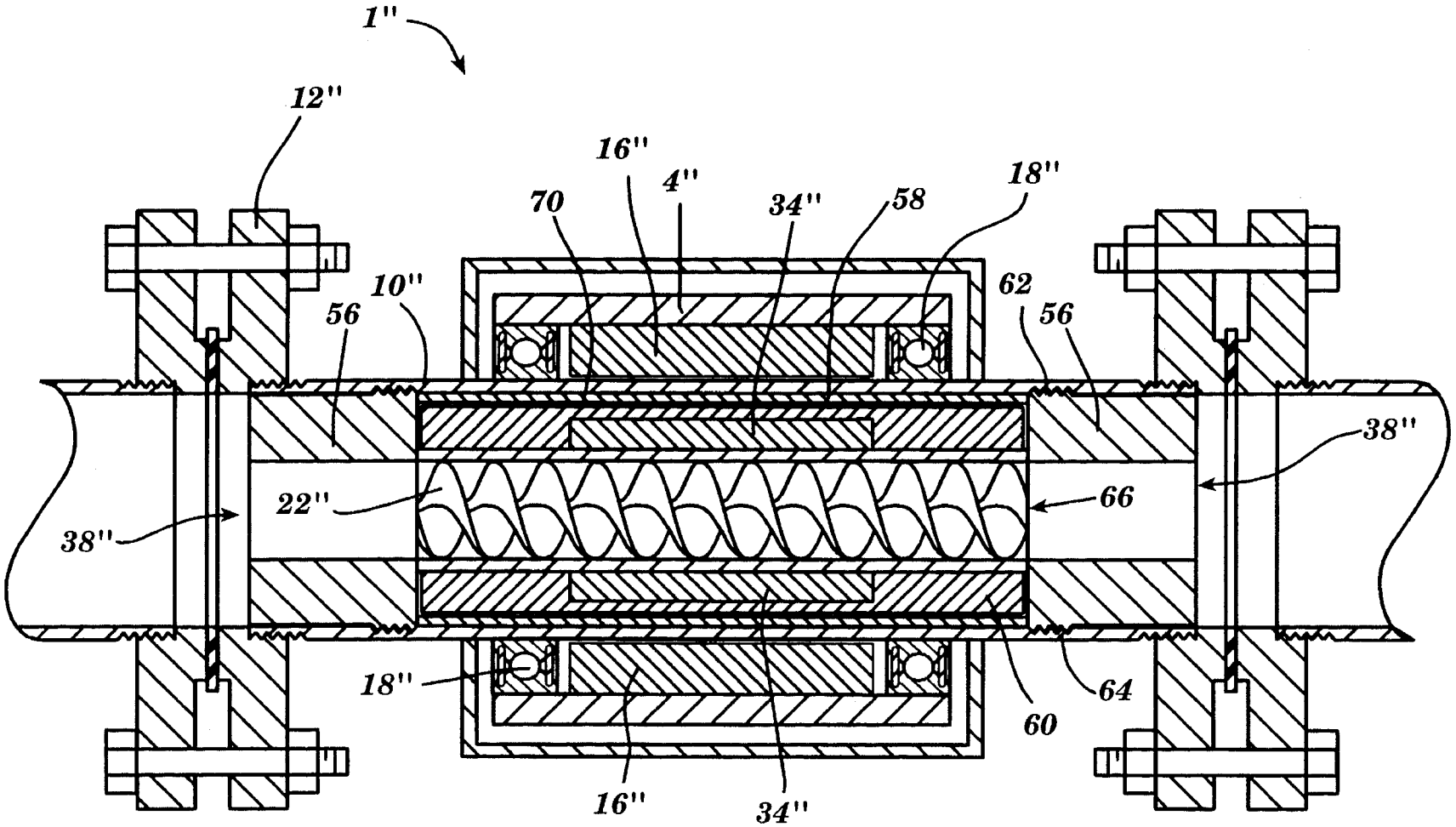
FIG. 4 is a cross-sectional view in the area of the pump casing of a third embodiment of a sealless pump in accordance with the invention.

FIG. 4 provides a detailed view, in the area of the pump casing, of a third embodiment 1" of the invention. As in the previously described embodiment, this embodiment of the invention includes most of the same structure as used in the first embodiment. However, in this embodiment, separate impeller support bearings (bearings 24 in the first embodiment) are not employed but their function is taken up by self-lubricating bushings 56, 58 and 60.

Bushings 56 are similar to bushings 42 of the second embodiment. The bushings have exterior threads 62 that mate with threads 64 located on the inner wall of the pump casing 10". The threaded engagement maintains bushings 56 in the position shown and allows said bushings to be easily removed from the casing through the casing's end-located openings 38".

Located between bushings 56 is a tubular bushing 58. The bushing 58 is in continual Contact with bushings 56 and thereby maintained in the position shown.

Bushing 58 is axially-aligned with and surrounds the body of the pump's impeller 66. The impeller is similar to the impeller used in the first and second embodiments and has an auger-like interior surface 22". However, in this embodiment, the magnets 34" that are secured to the impeller are completely encased in a plastic bushing material. In this manner, the exterior of the impeller forms bushing 60. In the preferred embodiment, bushings 56, 58 and 60 are all made of RULON or a similar low-friction plastic bushing material.

It should be noted that the casing's end-located openings 38" have a diameter slightly larger than that of the bushings 58 and 60. This enables the inner contents of the casing to be completely removed from either end of the casing.

Figure 5:
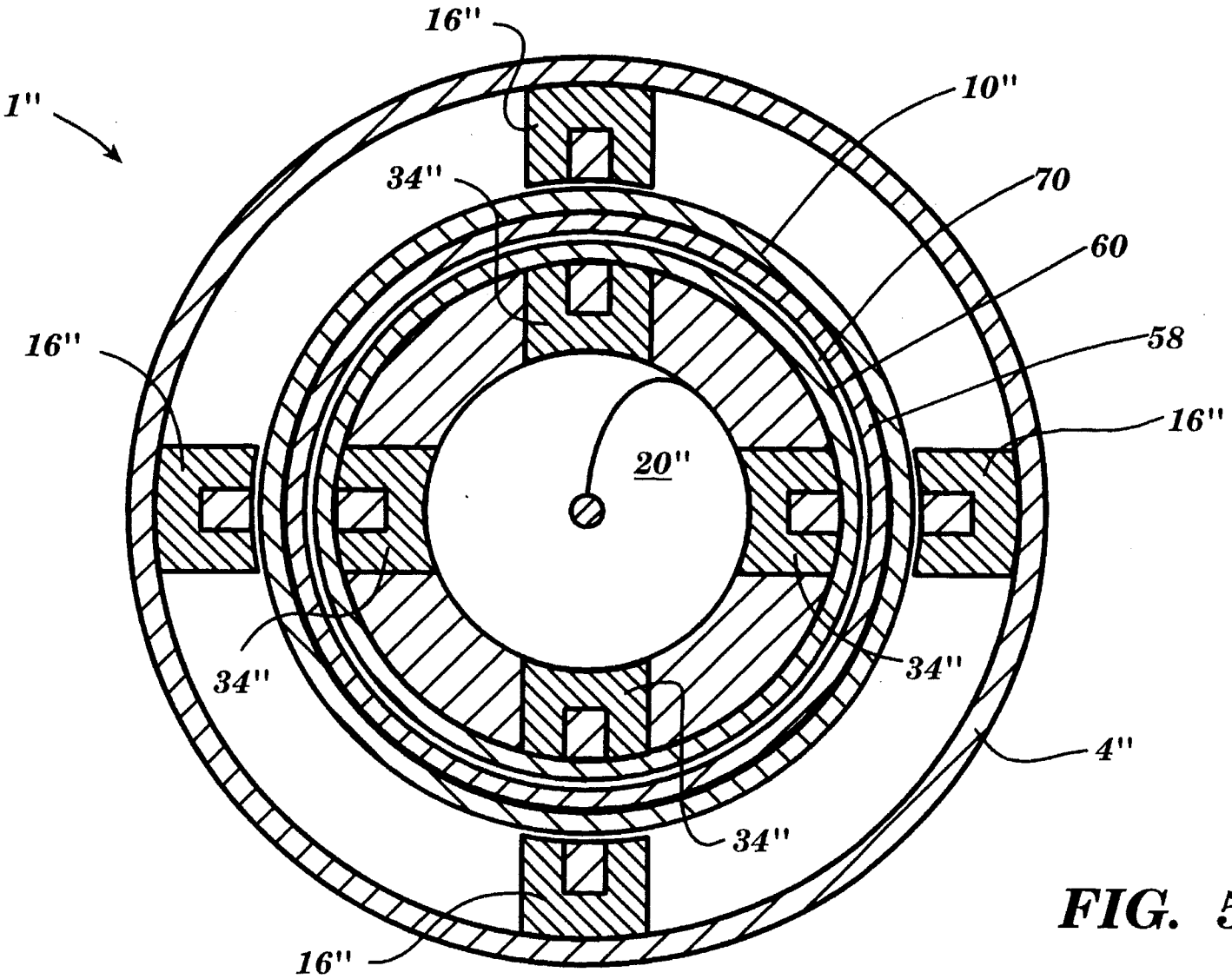
FIG. 5 is an end view of the structure shown in figure 4 taken at the plane labeled 5—5.

As can be seen in FIG. 5, the bushing 60 forms the exterior side surface of the impeller and rotates within stationary bushing 58. Since no support bearings are employed, contact may occur between the surfaces of bushings 58 and 60 during start-up conditions. However, once the impeller begins rotating and reaches a steady state condition, the balanced magnetic forces on its magnets 34" exerted by magnets 16" will maintain a gap 70 between the these bushing surfaces. At all times, the side-located bushings 56 contact bushing 60 to provide axially-directed support for the impeller as well as to provide a leak-proof seal to prevent water from entering gap 70. While the bearing and sealing functions for the impeller are accomplished by the four described bushings, it is within the realm of the invention that one or both of the bushings 56 may be replaced by appropriate shaping of the tubular bushing 58.

It should be noted that in all three embodiments of the invention the design of the pump greatly facilitates maintenance of the components within the pump casing. In addition, since every component located within the casing is removable from either end of the pump, the pump can be located where only one of its ends is accessible.

The embodiments disclosed herein have been discussed for the purpose of familiarizing the reader with the novel aspects of the invention. Although preferred embodiments of the invention have been shown and described, many changes, modifications and substitutions may be made by one having ordinary skill in the art without necessarily departing from the spirit and scope of the invention as described in the following claims.

I claim:

1. A pump having a magnetic coupling, said pump comprising:

a motor means;

a tubular pump casing that has an interior area that houses a rotatable impeller and wherein said interior area is in the form of a cylinder having a uniform diameter;

a rotatable housing surrounding at least a portion of said pump casing and operatively connected to said motor means;

a plurality of first magnets located about an interior surface of said housing and rotatable therewith;

a plurality of second magnets operatively connected to and rotatable with the impeller, wherein said second magnets are aligned with and magnetically coupled to said first magnets;

bearing means located within said pump casing and functioning to support said impeller within said pump casing; and seal means located within said pump casing, said seal means functioning to isolate the second magnets from any fluid being pumped by said pump.

2. The pump of claim 1 wherein said bearing means includes a plurality of ball bearings captured within a circular raceway.

3. The pump of claim 2 wherein the seal means is directly attached to the bearing means.

4. The pump of claim 1 wherein the second magnets are embedded in a bushing material thereby forming a bushing surface about the exterior surface of a body portion of the impeller and wherein a tubular bushing surrounds said bushing surface and remains stationary when said impeller rotates within said casing.

5. The pump of claim 1 wherein the bearing means and the seal means are in the form of bushings having complementary surfaces.

6. The pump of claim 5 wherein a gap is located between an interior wall of said pump casing and an outer edge of each of said second magnets and wherein a first bushing is located in said gap and wherein said first bushing is cylindrical and wherein a second cylindrical bushing encases said second magnets and is rotatable relative to said first bushing.

7. The pump of claim 6 wherein a third cylindrical bushing is located at a first end of said impeller and a fourth cylindrical bushing is located at a second end of said impeller and wherein said second bushing contacts said third and fourth bushings and rotates relative to said third and fourth bushings when said impeller is rotating within the pump casing.

8. The pump of claim 7 wherein at least one end of said pump casing has an opening of a diameter sufficient to allow at least one of said third or fourth bushings to be removed from said pump body through said opening without requiring any deformation of said bushing.

9. The pump of claim 8 wherein the impeller has a diameter less than said opening and wherein when at least one of said third or fourth bushings has been removed from said pump casing through said opening, said impeller and said first bushing may then be slidably removed from said pump casing through said opening.

10. The pump of claim 1 wherein the impeller has an auger-shaped interior surface.

11. A pump having a magnetic coupling, said pump comprising:

a motor means;

an elongated pump casing that has an interior area that houses an elongated rotatable impeller;

a rotatable housing surrounding at least a portion of said pump casing and operatively connected to said motor means;

a plurality of first magnets located about an interior surface of said housing and rotatable therewith;

a plurality of second magnets operatively connected to and rotatable with the impeller, wherein said second magnets are aligned with and magnetically coupled to said first magnets;

a first bushing that forms an exterior surface of a body portion of said impeller and wherein said second magnets are embedded in said first bushing;

a second bushing that is tubular in shape and surrounds said first bushing; and third and fourth bushings, wherein said third bushing is located adjacent a first end of said impeller and said fourth bushing is located adjacent to a second end of said impeller.

12. The pump of claim 11 wherein said pump casing has a first opening located at a first end of said casing and a second opening located at a second end of said casing and wherein said first and second openings are substantially equal in diameter and are larger in diameter than the third and fourth bushings.

13. A pump having a magnetic coupling, said pump comprising:

a motor means;

an elongated pump casing that has an interior area that houses a rotatable impeller, and wherein said pump casing is in the form of a straight tube having first and second ends;

a connection means located at each of said first and second ends of said casing;

a first opening located at the first end of said casing;

a second opening located at the second end of said casing;

a rotatable housing surrounding at least a portion of said pump casing and operatively connected to said motor means;

a plurality of first magnets located about an interior surface of said housing and rotatable therewith;

a plurality of second magnets operatively connected to and rotatable with the impeller, wherein said second magnets are aligned with and magnetically coupled to said first magnets;

bearing means located within said pump casing and functioning to support said impeller within said pump casing; and wherein said first and second openings are substantially equal in diameter and are larger in diameter than the impeller and bearing means.

14. The pump of claim 13 wherein the impeller has an auger-shaped interior surface.

* * * * *